US010113830B2

(12) United States Patent
Monveldt et al.

(10) Patent No.: US 10,113,830 B2
(45) Date of Patent: Oct. 30, 2018

(54) PUMP-ACTION FIREARM WITH BOLT CARRIER LOCKING MECHANISM AND FOLDING BUTT STOCK

(71) Applicant: Troy Industries, Inc., West Springfield, MA (US)

(72) Inventors: Sergey Monveldt, South Hadley, MA (US); Stephen P. Troy, West Springfield, MA (US); David Hewes, Chesterfield, MA (US); James P. Demaree, Avon, CT (US)

(73) Assignee: TROY INDUSTRIES, INC., West Springfield, MA (US)

( * ) Notice: Subject to any disclaimer, the term of this patent is extended or adjusted under 35 U.S.C. 154(b) by 0 days.

(21) Appl. No.: 15/162,571

(22) Filed: May 23, 2016

(65) Prior Publication Data

US 2016/0349001 A1 Dec. 1, 2016

Related U.S. Application Data

(62) Division of application No. 14/284,376, filed on May 21, 2014, now Pat. No. 9,347,737.

(Continued)

(51) Int. Cl.
*F41C 23/16* (2006.01)
*F41C 23/04* (2006.01)

(Continued)

(52) U.S. Cl.
CPC ..... *F41C 23/04* (2013.01); *F41C 7/02* (2013.01); *F41A 3/38* (2013.01); *F41A 3/44* (2013.01)

(58) Field of Classification Search
CPC .... F41A 3/72; F41A 3/66; F41C 23/04; F41C 23/16; F41G 11/003

(Continued)

(56) References Cited

U.S. PATENT DOCUMENTS 2,400,349 A * 5/1946 Haberstump ..... F41C 23/04 42/72
2,405,758 A * 8/1946 Sampson ..... F41C 23/04 42/72

(Continued)

FOREIGN PATENT DOCUMENTS

DE 102013202842 8/2013
WO 2010009725 1/2010
WO 2012001287 1/2012

OTHER PUBLICATIONS

International Search Report and Written Opinion dated Sep. 30, 2015 in corresponding PCT Patent Application No. PCT/US14/62969.

(Continued)

*Primary Examiner* — Michael D David

(74) *Attorney, Agent, or Firm* — Grossman, Tucker, Perreault & Pfleger, PLLC

(57) ABSTRACT

A butt stock for a firearm including the butt stock arrangeable in a first configuration to fold toward a first side of a receiver of the firearm into a first folded position along the first side of the receiver, and unfoldable away from the first side of the receiver of the firearm into an unfolded position rearward of the receiver; and the butt stock arrangeable in a second configuration to fold toward a second side of the receiver of the firearm into a second folded position along the second side of the receiver, and unfoldable away from the second side of the receiver of the firearm into the unfolded position rearward of the receiver.

12 Claims, 13 Drawing Sheets

Related U.S. Application Data

(60) Provisional application No. 61/897,170, filed on Oct. 29, 2013.

(51) Int. Cl.
*F41C 7/02* (2006.01)
*F41A 3/38* (2006.01)
*F41A 3/44* (2006.01)

(58) Field of Classification Search
USPC ..... 42/16, 73, 84, 71.01, 72, 75.01; 89/193, 89/191.02
See application file for complete search history.

(56) References Cited

U.S. PATENT DOCUMENTS 2,628,536 A * 2/1953 Schaich ..... F41A 3/26 42/69.02
2,861,374 A 11/1958 Hampton
3,798,819 A * 3/1974 Hillberg ..... F41C 23/00 42/71.01
4,044,487 A 8/1977 Hutton
4,867,039 A 9/1989 Dobbins
4,905,395 A 3/1990 Wagner
5,068,992 A 12/1991 Velezis
6,490,822 B1 12/2002 Swan
6,671,990 B1 1/2004 Booth
6,782,652 B1 8/2004 Erickson
6,782,791 B2 8/2004 Moore
7,337,574 B2 3/2008 Crandall
7,493,718 B2 * 2/2009 Gorzen ..... F41A 3/10 42/42.02
7,610,844 B2 11/2009 Kuczynko
7,634,959 B2 12/2009 Frickey
7,661,220 B2 2/2010 Crandall
7,775,150 B2 8/2010 Hochstrate
7,934,447 B2 5/2011 Kuczynko
7,938,055 B2 5/2011 Hochstrate
8,117,958 B2 2/2012 Hochstrate
8,393,107 B2 3/2013 Brown
8,505,433 B2 8/2013 Hochstrate
8,726,557 B2 5/2014 Stone
8,783,160 B2 7/2014 Hochstrate
8,943,948 B2 2/2015 Kuczynko
9,347,737 B2 5/2016 Troy et al.
9,739,565 B2 * 8/2017 Kielsmeier ..... F41C 23/04
9,851,175 B2 * 12/2017 Leasure ..... F41C 23/16
2006/0065112 A1 3/2006 Kuczynko
2006/0260169 A1 11/2006 Samson et al.
2007/0033851 A1 2/2007 Hochstrate
2007/0199225 A1 8/2007 Haugen
2007/0199435 A1 8/2007 Hochstrate
2010/0095834 A1 4/2010 Kuczynko
2010/0300277 A1 12/2010 Hochstrate
2010/0319231 A1 12/2010 Stone
2011/0107644 A1 5/2011 Faifer
2011/0225865 A1 9/2011 Williams
2011/0247254 A1 10/2011 Barnes
2011/0265640 A1 11/2011 Kuczynko
2011/0275435 A1 11/2011 Torre et al.
2011/0283582 A1 11/2011 Hunter et al.
2012/0137561 A1 * 6/2012 Ludlow ..... F41C 23/04 42/75.03
2012/0137562 A1 * 6/2012 Langevin ..... F41C 23/04 42/75.03
2012/0137872 A1 6/2012 Crommett
2012/0204466 A1 8/2012 Bayne
2012/0297970 A1 11/2012 Langevin et al.
2013/0212920 A1 * 8/2013 Law ..... F41C 23/14 42/75.03
2014/0311004 A1 10/2014 Barrett
2015/0113848 A1 * 4/2015 Monveldt ..... F41C 7/02 42/16

OTHER PUBLICATIONS

European Extended Search Report dated Apr. 11, 2017 in connection with European Patent Application No. 14881033.6.
Extended European Search Report from related Application No. 18 158 480.6, dated May 4, 2018.
Fab Defense: "Fab Defense 2012", Mishmar HaShiva Israel, Sep. 19, 2011 (Sep. 19, 2011), XP055472708, Retrieved from the Internet: URL: https://www.fab-defense.com/download/Fab-catalog-2012.pdf (retrieved on May 4, 2018), 39 pages.

* cited by examiner

PUMP-ACTION FIREARM WITH BOLT CARRIER LOCKING MECHANISM AND FOLDING BUTT STOCK

CROSS REFERENCE TO RELATED APPLICATIONS

This application is a divisional application of U.S. application Ser. No. 14/284,376 filed May 21, 2014, now pending, which claims the benefit of the filing date of U.S. provisional patent application Ser. No. 61/897,170, filed Oct. 29, 2013, the entire disclosure of each of which is incorporated herein by reference.

FIELD

The present disclosure relates generally to firearms and, more particularly, to pump-action firearms, such as a pump-action rifle, which may include a bolt carrier locking mechanism and a folding butt stock.

BACKGROUND

Certain semi-automatic and automatic firearms, such as the family of AR-15/M16 rifles, operate with a gas operating system in which hot propellant combustion gas from a fired cartridge is made to operate the bolt carrier to cycle the action of the firearm.

The gas operating system of an AR-15/M16 rifle may be a direct gas impingement system, or a gas operated piston system. The direct gas impingement system directs hot propellant combustion gas from a fired cartridge directly to a bolt carrier to cycle the action of the firearm. More particularly, the gas pressure of the combustion gas pushes the bolt carrier rearward against the bias of a buffer spring, during which time the fired cartridge case is extracted from the chamber of the barrel and ejected from the firearm. As the gas pressure dissipates, the compressed buffer spring then decompresses and pushes the bolt carrier forward, during which time an unfired cartridge is removed from the magazine and loaded into the chamber of the barrel. In contrast to a direct gas impingement system, with a gas operated piston system, the gas forces a piston rod of a piston and the bolt carrier rearward to handle the extraction and ejection process, and thereafter the bolt carrier is forced forward by a decompression of the buffer spring to the closed position just as with direct impingement.

Operation of semi-automatic and automatic firearms, including operation of the AR-15/M16 family of rifles, is well known and described, for example, in U.S. Patent Application Publication No. US2012/0137872, the teachings of which are hereby incorporated herein by reference.

Certain shotguns may be operated with either a semi-automatic reload system or a manual pump-action reloading system. With a manual pump-action reloading system, rather than the reloading system being operated by gas from a fired cartridge, actuation of the reloading system is performed manually by the operator (shooter) of the shotgun. For both the semi-automatic and pump-action shotguns, shotgun shells are generally stored in a tubular magazine beneath the barrel, which is not detachable from the shotgun such that the shotgun may be operated with the use of multiple magazines.

SUMMARY

A firearm according to the present disclosure may be understood as a pump-action firearm, particularly a pump-action rifle. More particularly, the pump-action firearm of the present disclosure may be made to look similar to, as well as share many features with, an AR-15/M16 rifle, although the firearm of the present disclosure operates with a pump-action reload mechanism rather than with a traditional gas operated reloading system associated with an AR-15/M16. In addition, or alternatively, a firearm according to the present disclosure may include a bolt carrier locking mechanism and/or a butt stock that may be folded in either direction toward the receiver of the firearm.

In at least one embodiment, a firearm according to the present disclosure may comprise a barrel; a handguard disposed around the barrel; a manually operated pump-action reload mechanism, the pump-action reload mechanism comprising a hand-held actuation arrangement and a fore-end body, the fore-end body disposed around the barrel between the handguard and the barrel; and the hand-held actuation arrangement coupled to the fore-end body to operate the pump-action reload mechanism.

In at least one embodiment, the pump-action reload mechanism may further comprise an operation rod, and the operation rod may be coupled to the fore-end body and a bolt carrier of the firearm.

In certain embodiments, the fore-end body may be arranged to travel along a length of the barrel during an operation of the pump-action reload mechanism without the fore-end body contacting the barrel.

In at least one embodiment, the hand-held actuation arrangement may comprise a first actuation section.

In at least one embodiment, the handguard may comprise a first actuation section travel slot, and the first actuation section may be configured to travel within the first actuation section travel slot during a reloading of the firearm.

In at least one embodiment, the fore-end body may be disposed inside the handguard, the first actuation section may comprise a first hand-grip segment disposed outside the handguard and the fore-end body and the first hand-grip segment may be coupled to one another by at least one fastening device disposed within the first elongated slot.

In at least one embodiment, the first hand-grip segment may be adjacent an outside surface of the handguard.

In at least one embodiment, the at least one fastening device may be located within a stand-off boss on at least one of the first hand-grip segment and the fore-end body.

In at least one embodiment, the stand-off boss may be disposed within the first actuation section travel slot.

In at least one embodiment, the first hand-grip segment may comprise a rail segment.

In at least one embodiment, the rail segment may have a T-shaped profile.

In at least one embodiment, the first actuation section may comprise a plastic hand-grip.

In at least one embodiment, the first actuation section may be disposed beneath the barrel.

In at least one embodiment, the hand-held actuation arrangement may comprise a second actuation section.

In at least one embodiment, the handguard may comprise a second actuation section travel slot, and the second actuation section may be configured to travel within the second actuation section travel slot during the reloading of the firearm.

In at least one embodiment, the second actuation section may be disposed on a side of the barrel approximately 90 degrees from the first actuation section.

In at least one embodiment, the first actuation section and the second actuation section may be discrete components of the hand-held actuation member.

In at least one embodiment, the hand-held actuation arrangement may comprise a third actuation section.

In at least one embodiment, the handguard may comprise a third actuation section travel slot, and the third actuation section may be configured to travel within the third actuation section travel slot during the reloading of the firearm.

In at least one embodiment, the third actuation section may be disposed on a side of the barrel approximately 180 degrees from the second actuation section.

In at least one embodiment, the first actuation section, the second actuation section and the third actuation section may be discrete components of the hand-held actuation member.

In at least one embodiment, the firearm may be a rifle.

In at least one embodiment, the firearm may further comprise a bolt and a bolt carrier, and, during operation of the firearm, the bolt may be locked with the barrel.

In at least one embodiment, the firearm may further comprise a detachable magazine.

In at least one embodiment, the firearm may further comprise a bolt carrier, and a bolt carrier locking mechanism arranged to inhibit the bolt carrier from rearward travel while an unfired cartridge is located in a chamber of the barrel.

In at least one embodiment, the bolt carrier locking mechanism may comprise a bolt carrier locking member, and the bolt carrier locking member may be movable transverse to a longitudinal axis of the bolt carrier.

In at least one embodiment, the firearm may further comprise a firing hammer; and the firing hammer and the bolt carrier locking member may be arranged such that the bolt carrier locking member is arranged to move transverse to the longitudinal axis of the bolt carrier and out of alignment with the firing hammer in response to being contacted by the firing hammer.

In at least one embodiment, the bolt carrier locking mechanism may comprise a spring, and the bolt carrier locking member and the spring may be arranged such that a transverse movement of the bolt carrier locking member in response to being contacted by the firing hammer is biased by the spring.

In at least one embodiment, the bolt carrier locking member may be arranged to move transverse to the longitudinal axis of the bolt carrier on a pin.

In at least one embodiment, the bolt carrier locking mechanism may comprise a manual release button, and the manual release button and the bolt carrier locking member may be arranged such that pushing on the manual release button moves the bolt carrier locking member transverse to the longitudinal axis of the bolt carrier.

In at least one embodiment, the bolt carrier locking mechanism may comprise a bolt carrier locking member, and the bolt carrier locking member may be rotatable on an axis which is transverse to a longitudinal axis of the bolt carrier.

In at least one embodiment, the firearm may further comprise a firing hammer, and the firing hammer and the bolt carrier locking member may be arranged such that the bolt carrier locking member is arranged to rotate out of engagement with the bolt carrier in response to being contacted by the firing hammer.

In at least one embodiment, the bolt carrier locking mechanism may comprise a spring, and the bold carrier locking member and the spring may be arranged such that a rotational movement of the bolt carrier locking member in response to being contacted by the firing hammer is biased by a spring.

In at least one embodiment, the bolt carrier locking member may be arranged to rotate out of engagement with the bolt carrier on a pin.

In at least one embodiment, the bolt carrier locking mechanism may comprise a manual release button, and the manual release button and the bolt carrier locking member may be arranged such that pushing the manual release button rotates the bolt carrier locking member out of engagement with the bolt carrier.

In at least one embodiment, a butt stock for a firearm according to the present disclosure may comprise the butt stock arrangeable in a first configuration to fold toward a first side of a receiver of the firearm into a first folded position along the first side of the receiver, and unfoldable away from the first side of the receiver of the firearm into an unfolded position rearward of the receiver, and the butt stock arrangeable in a second configuration to fold toward a second side of the receiver of the firearm into a second folded position along the second side of the receiver, and unfoldable away from the second side of the receiver of the firearm into the unfolded position rearward of the receiver.

In at least one embodiment, the butt stock may further comprise a hinge, and, in the first configuration of the butt stock, the hinge may be disposed to the first side of the receiver, and, in the second configuration of the butt stock, the hinge may be disposed to the second side of the receiver.

In at least one embodiment, the butt stock may be connectable to the receiver by a mounting bracket member which includes the hinge.

In at least one embodiment, the butt stock of claim may further comprise a latch, and, in the first configuration of the butt stock, the latch may be disposed to the second side of the receiver, and, in the second configuration of the butt stock, the latch may be disposed to the first side of the receiver.

In at least one embodiment, the butt stock may be connectable to the receiver by a mounting bracket member which includes the latch.

In at least one embodiment, the butt stock of claim may further comprise an extendable elongated body comprising a first elongated body member and a second elongated body member, the butt stock has a longitudinal axis, and to arrange the butt stock in the second configuration from the first configuration, the first body member may be rotated about the longitudinal axis of the butt stock relative to the second elongated body member.

In at least one embodiment, the second body member slides relative to the first body member to adjust a length of the butt stock.

In at least one embodiment, the length of the butt stock may be locked by a locking mechanism.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

A firearm according to the present disclosure may be understood as a pump-action firearm, particularly a pump-action rifle. More particularly, the pump-action firearm of the present disclosure may be made to look similar to, as well as share many features with, an AR-15/M16 rifle, although the firearm of the present disclosure operates with a pump-action reload mechanism, rather than with a traditional gas operated reloading system associated with an AR-15/M16. In addition, or alternatively, a firearm according to the present disclosure may include a bolt carrier locking mechanism and/or a butt stock that may be folded in either direction toward the receiver of the firearm.

As may be understood, a pump-action firearm includes a fore-end which may be "pumped" rearward relative to the firearm (and the firing direction thereof) to eject a fired cartridge casing from the chamber of the barrel of the firearm, and thereafter "pumped" forward relative to the firearm (and the firing direction thereof) to extract an unfired cartridge from a magazine and load the unfired cartridge into the chamber of the barrel.

Figure 1:
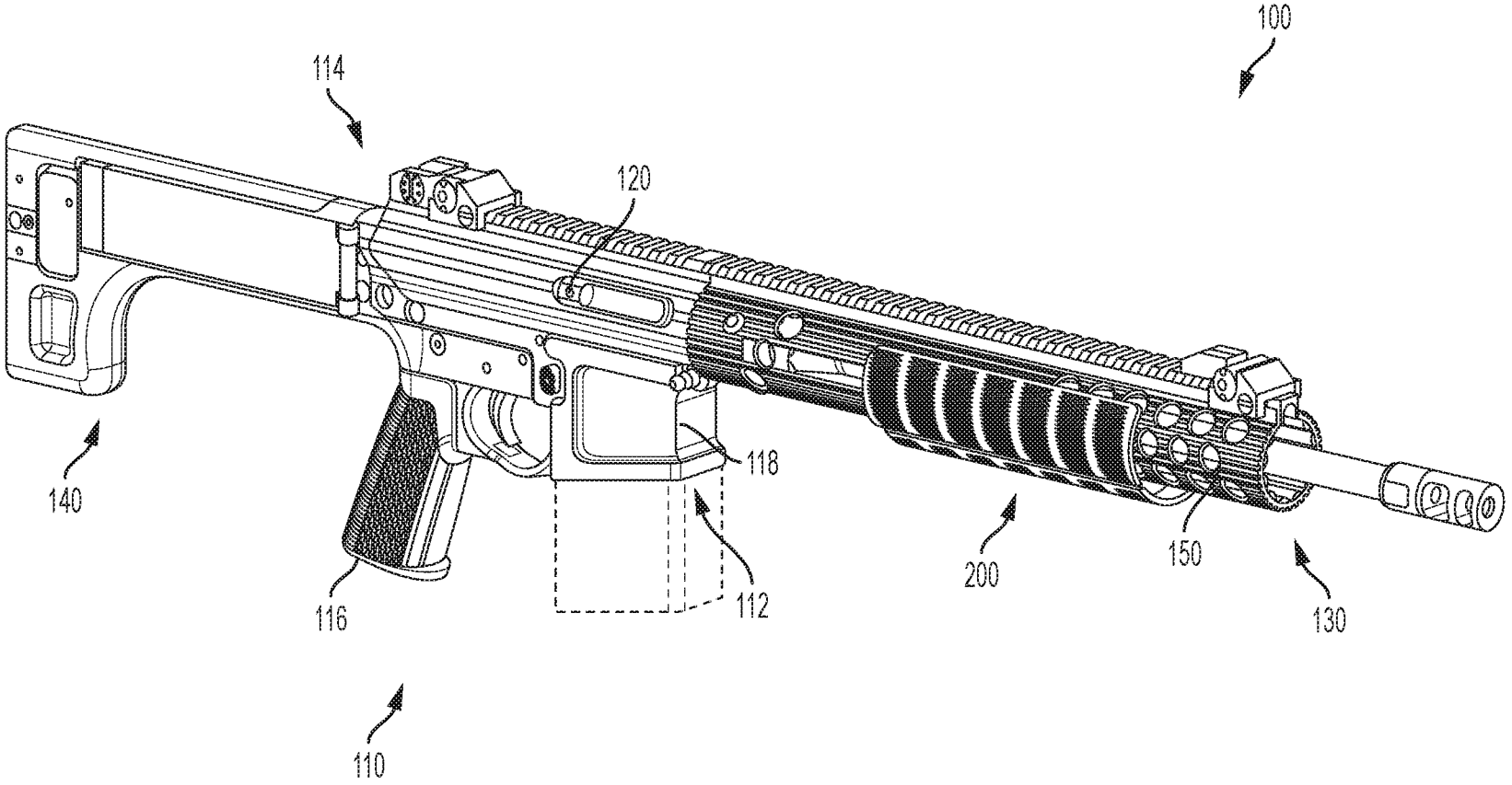
FIG. 1 is a perspective view of a firearm having a manually operated pump-action reload mechanism according to the present disclosure.

Turning now to FIG. 1, there is illustrated a firearm 100 according to the present disclosure. Firearm 100 includes a receiver 110 comprising a lower receiver 112 and mating upper receiver 114. Upper receiver 114 includes bolt carrier 120 including a firing pin, as well as a cartridge loading and unloading mechanism. A barrel 130 is affixed to the front end of upper receiver 114 and a butt stock 140 is affixed to the rear end of lower receiver 112. A trigger portion of upper receiver 114 fits into an access opening in lower receiver 112 and is integrated with the internal mechanism of upper receiver 114 and lower receiver 112. A pistol grip 116 is attached to lower receiver 112. A detachable (removable) box magazine as known in the art (shown in phantom) may be inserted into a magazine receptacle 118 having a downwardly oriented access opening in lower receiver 112 for feeding cartridges to the cartridge insertion and ejection mechanism within upper receiver 114. The detachable magazine is capable of being loaded and unloaded while detached from firearm 100, and holds the cartridges side-by-side in one or more columns/rows, which may be staggered. In certain embodiments, the detachable magazine may also comprise a drum magazine in which the cartridges are positioned and fed in an unwinding spiral.

A handguard 150 is affixed to the front end of upper receiver 114 and surrounds and protects a portion of barrel 130. A pump-action reload mechanism 200 overlies at least a proximal portion of the barrel 130 and the handguard 150.

During operation of the pump-action reload mechanism 200, as the mechanism is "pumped" rearward relative to the firearm (and the firing direction thereof), a rearward force is applied to the bolt carrier 120 which forces the bolt carrier 120 to travel rearwards and the bolt to rotate in the bolt carrier 120 via a cam and pin setup. As with the AR-15/M16, the rotation of the bolt disengages radial locking teeth, located at the bolt head, from the lugs on the barrel extension, unlocking the bolt and allowing the bolt carrier to fully travel rearward, thereby extracting and ejecting a fired cartridge case on its rearward motion.

Thereafter, as the pump-action reload mechanism 200 is "pumped" forward relative to the firearm (and the firing direction thereof), the bolt carrier 120 travels forward, during which time an unfired cartridge is removed from the magazine and loaded into the chamber of the barrel 130. Once the bolt comes into the battery (forward most position), the bolt carrier 120 forces it to rotate and lock with the barrel extension.

A first embodiment of a manually operated pump-action reload mechanism 200 of firearm 100 according to the present disclosure is illustrated in FIGS. 2A-2F.

Figure 2A:
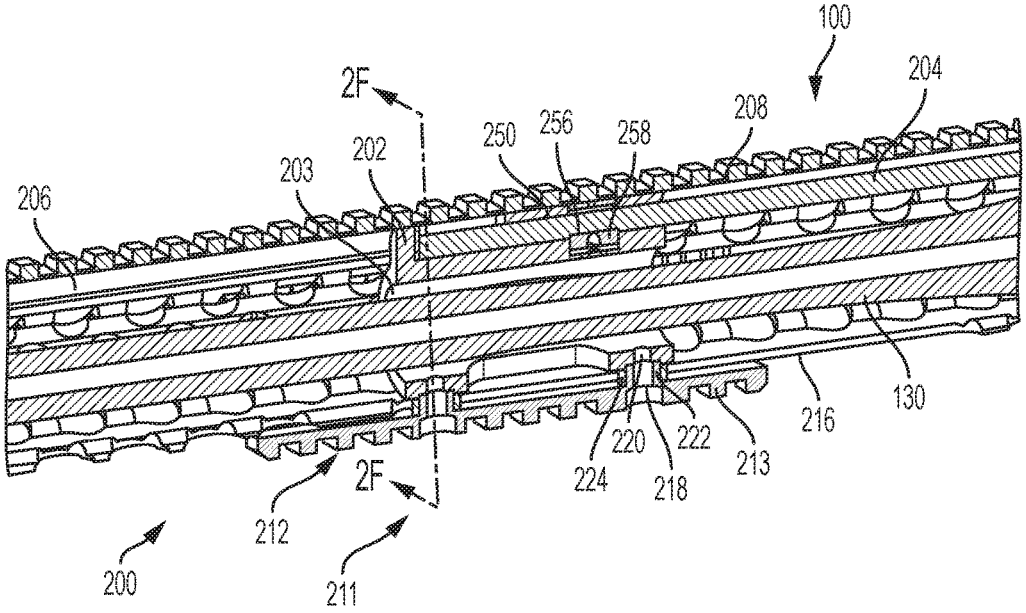
FIG. 2A is a cross-sectional perspective view of a fore-end portion of the pump-action reload mechanism of the firearm of FIG. 1 according to a first embodiment of the present disclosure.
Figure 2B:
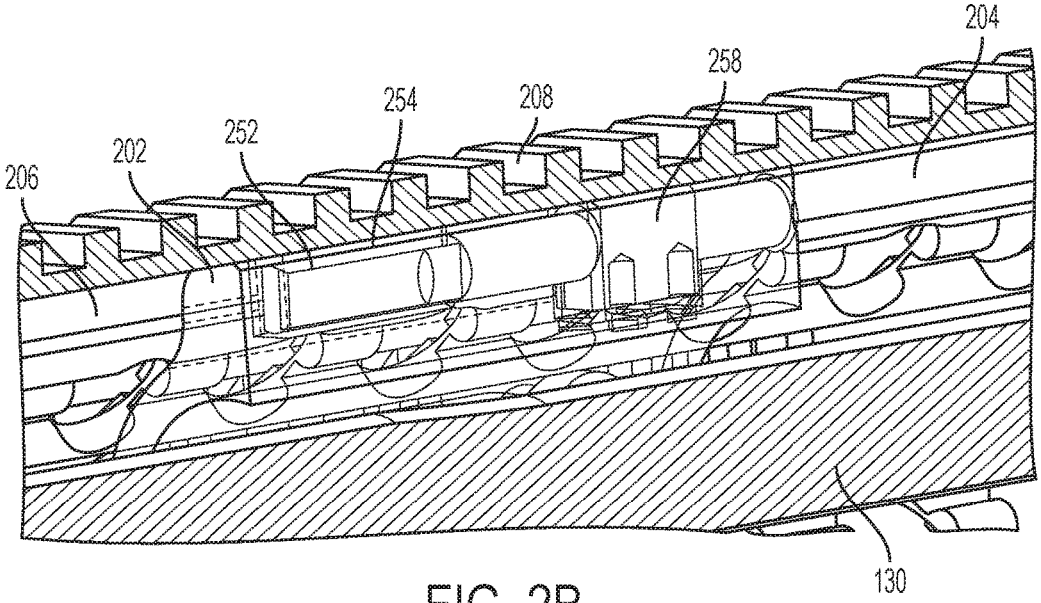
FIG. 2B is a close-up perspective view of portion of a fore-end body and an operation rod of the pump-action reload mechanism of the first embodiment.
Figure 2C:
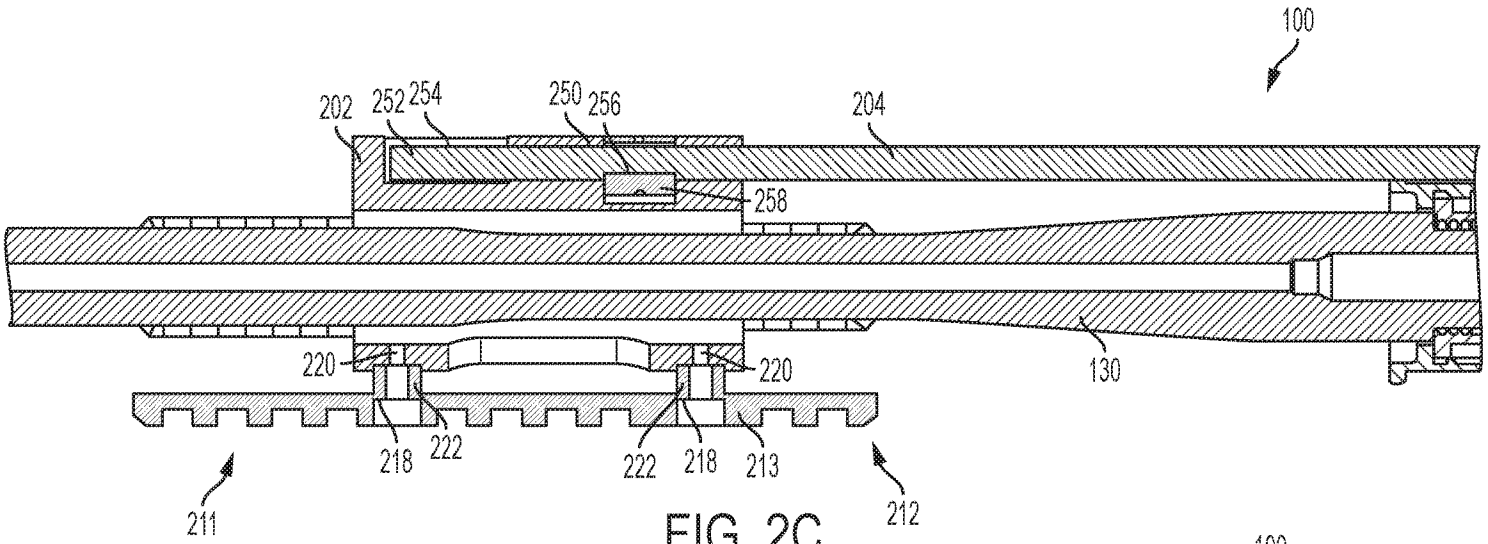
FIG. 2C is a cross-sectional side view of the fore-end portion of the pump-action reload mechanism of the first embodiment, with the handguard removed.
Figure 2D:
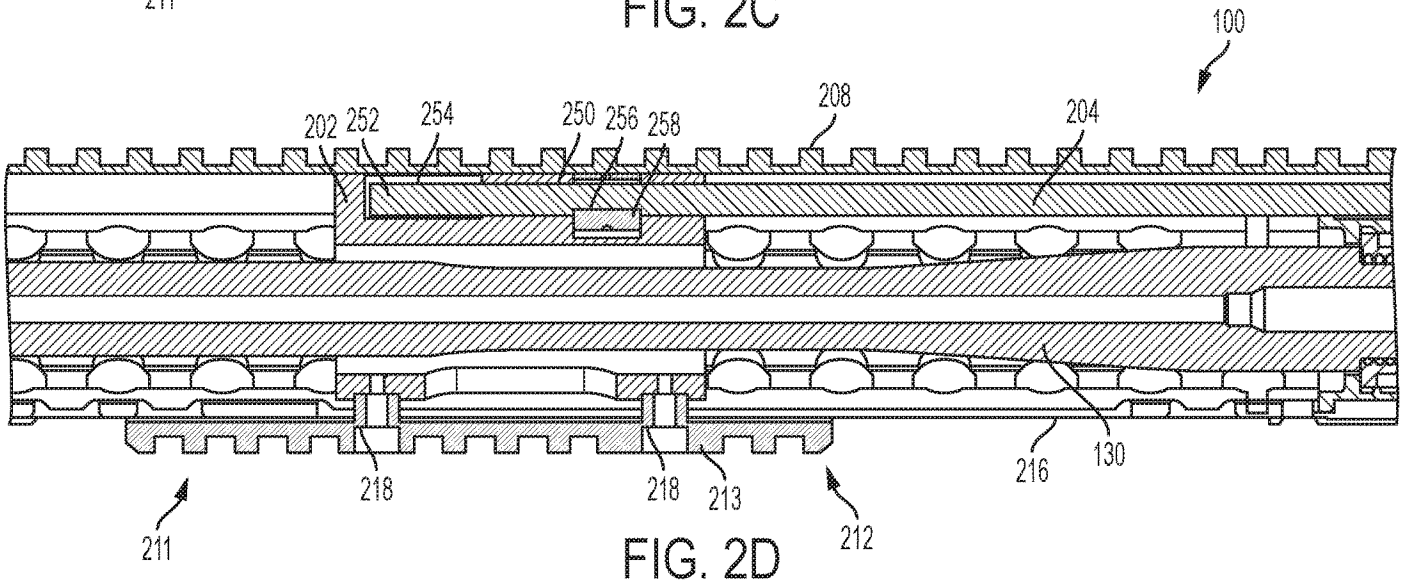
FIG. 2D is a cross-sectional side view of the fore-end portion of the pump-action reload mechanism of the first embodiment, with the handguard present.
Figure 2E:
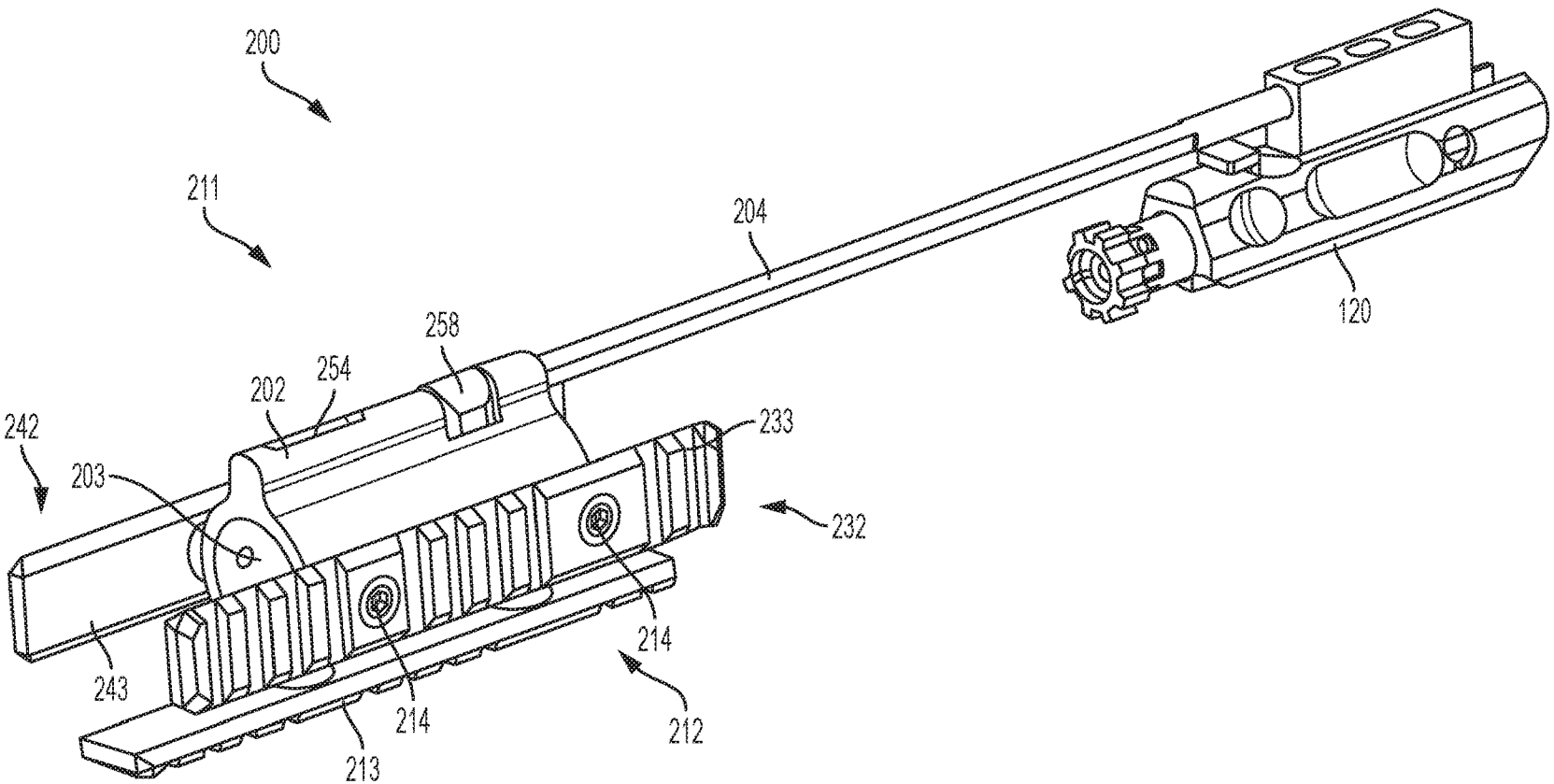
FIG. 2E is a perspective view of the pump-action reload mechanism of the first embodiment.

In the illustrated exemplary embodiment, the pump-action reload mechanism 200 of the operating system of the firearm 100 includes a fore-end (pump) body 202 that is coupled by operation rod 204 to bolt carrier 120 of firearm 100 (as shown in FIG. 2E). Those of ordinary skill in the art will recognize that the forward end of the operation rod 204 may be coupled, directly or indirectly, to the fore-end body 202 and the opposing rearward end of the operation rod 204 may be coupled, directly or indirectly, to the bolt carrier 120 by a variety of means depending on the configuration of the firearm 100. For example, the operation rod 204 may be secured to the fore-end body 202 and the bolt carrier 120 by one or more mechanical fastening devices, by welding, etc.

In addition, although the illustrated exemplary embodiment illustrates only a single operation rod 204 which extends along the top of the barrel 130, more than one operation rod 204 may be used to couple the fore-end body 202 to the bolt carrier 120. Those of ordinary skill in the art will recognize that the fore-end of the firearm 100 may be understood to be that portion of the firearm 100 forward of the trigger guard or receiver 110.

The fore-end body 202 is disposed around the barrel 130, particularly between the barrel 130 and an outer tubular (cylindrical) handguard 208 (which is shown to comprise a railed handguard having a Picatinny rail along the top thereof) which is disposed around and surrounds the fore-end body 202 and the barrel 130. The tubular structure of the handguard 208 may be provided by a single piece tubular member or may be provided by two or more semi-circular members fastened together.

Figure 2F:
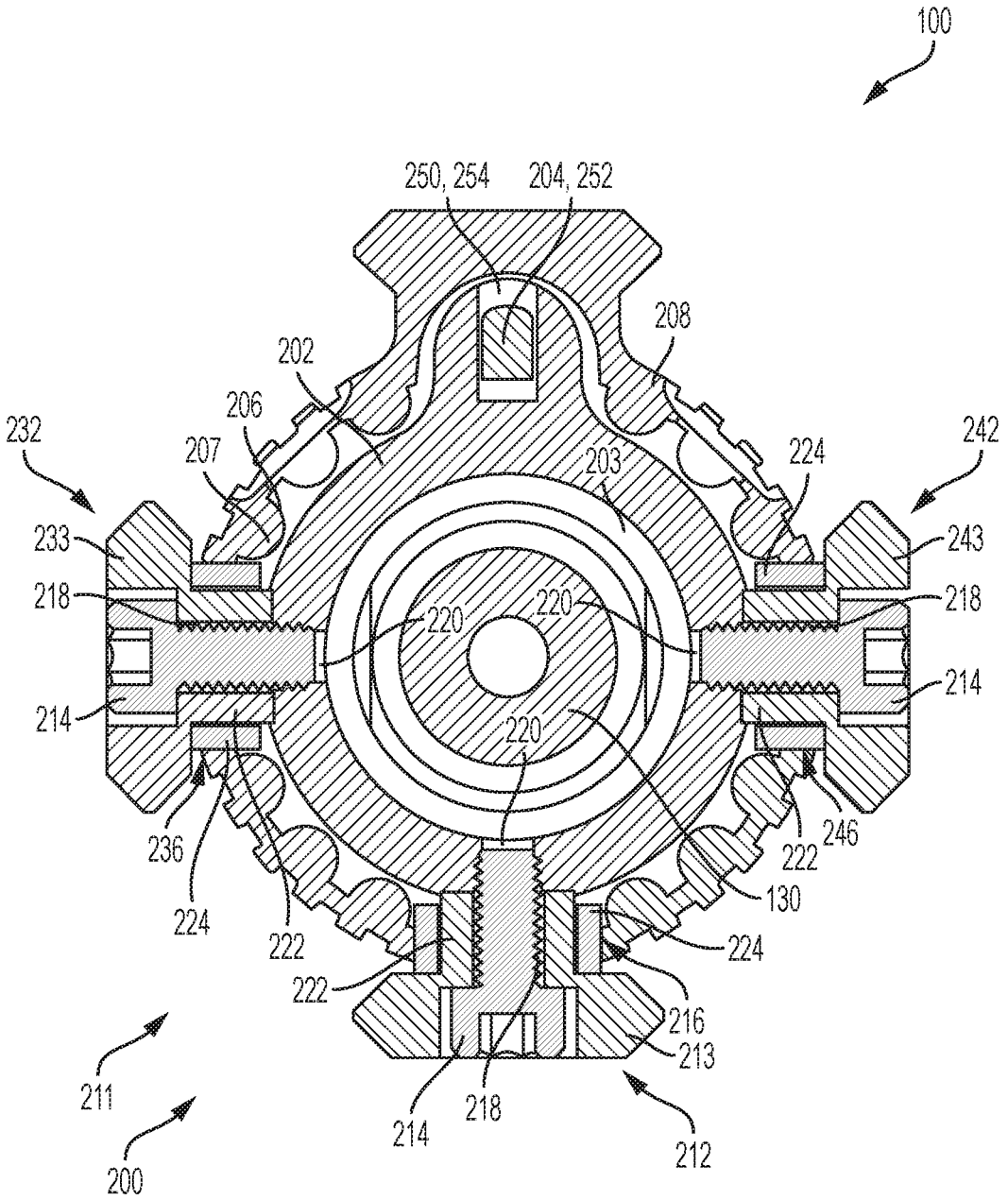
FIG. 2F is a cross-sectional view of the fore-end portion of the pump-action reload mechanism of the first embodiment, taken along section line 2F-2F of FIG. 2A.

In the illustrated exemplary embodiment, the fore-end body 202 has a substantially cylindrical tubular shape, with the barrel 130 extending through a centrally located cylindrical through passage 203 of the fore-end body 202. As best shown by FIG. 2F, the diameter of the cylindrical through passage 203 is greater than the outside diameter of the barrel 130 such that the fore-end body 202 may travel along a length of the barrel 130 with reciprocating movement along the inside profile 206 of the handguard 208 during an operation of the pump-action reload mechanism 200 without the fore-end body 202 making contact with the barrel 130, allowing the barrel 130 to free-float increasing the rifle's accuracy. As shown, the inside profile 206 of the handguard 208 includes a plurality of parallel, semi-circular ribs 207 which extend longitudinally with the handguard 208 and which surround the fore-end body 202 to better enable operation of the fore-end body 202.

The fore-end body 202 is also coupled to a hand-held actuation arrangement 211 comprising at least a first actuation section 212 to operate the pump-action reload mechanism 200. As shown in FIGS. 2A-2F, the first actuation section 212 is disposed beneath the barrel 130. Also as shown, the handguard 208 comprises a first actuation section travel slot 216, with the first actuation section 212 being configured to travel within the first actuation section travel slot 216 during a reloading of the firearm 100.

More particularly, the first actuation section 212 comprises a first actuation section hand-grip segment 213 positioned outside (radially outwardly adjacent the outer surface) of the handguard 208, which is coupled to the fore-end body 202 by one or more mechanical fastening devices 214 (e.g. threaded fasteners) which is disposed within and extends through the first actuation section travel slot 216 in the handguard 208. As best shown by FIG. 2F, the hand-grip segment 213 may comprise a mounting rail segment having a T-shaped cross-sectional profile (transverse to the longitudinal axis of the barrel 130). In this manner, the hand-grip segment 213 may also be used to mount accessory components, such as a flashlight, pistol grip or other accessory. In addition, the first actuation section 212 may further comprise a plastic (e.g. rubber) member which overlies the hand-grip segment 213 to make the hand-grip segment 213 easier to hold.

As best shown by FIG. 2F, in order to assemble the first actuation section 212 to the fore-end body 202 after the fore-end body 202 is within the handguard 208, attachment through-holes 218, 220 in the first hand-grip segment 213 and the fore-end body 202, respectively, may be aligned and a fastening device 214 in the form of a threaded fastener (e.g. cap screws) may be inserted therein and threadably engage with female threads within through-hole 220 of fore-end body 202. As shown, the fastener through-hole 218 formed within the first hand-grip segment 213 may extend through a cylindrical stand-off (mounting) boss 222 which secures against the fore-end body 202. The mounting boss 222 may be surrounded by a cylindrical bushing 224 which functions as a bearing in the event the bushing 224 makes contact with the inner surface the first actuation section travel slot 216 during actuation of the pump-action reload mechanism 200.

To chamber a cartridge, the pump-action reload mechanism 200 may be actuated by the operator of firearm 100 grasping the hand-grip segment 213 of the first actuation section 212 of the hand-held actuation arrangement 211 of the pump-action reload mechanism 200 and moving the hand-grip segment 213/fore-end body 202 rearwards towards the receiver of the firearm 100 by application of a rearward force on the hand-grip segment 213 (which is guided in the first actuation section travel slot 216 with the fastening device 244/stand-off bosses 222/bushings 224 traveling within first actuation section travel slot 216) to unlock the bolt from the barrel 130, move the bolt carrier 120 and bolt rearward to extract the fired cartridge case from the chamber of the barrel 130, and ejected the fired cartridge from the firearm 100.

Thereafter, the pump-action reload mechanism 200 may be actuated by the operator of firearm 100 grasping the hand-grip segment 213 of the first actuation section 212 of the hand-held actuation arrangement 211 of the pump-action reload mechanism 200 and moving the hand-grip segment 213/fore-end body 202 forward away from the receiver of the firearm 100 by application of a forward force on the hand-grip segment 213 to remove an unfired cartridge from the magazine, load it into the chamber as the bolt and bolt carrier 120 move forward and lock the bolt to the barrel 130.

As best shown in FIGS. 2E and 2F, the pump-action reload mechanism 200 may further comprise a second hand-grip segment 233 of a second actuation section 232 of the hand-held actuation arrangement 211 which is configured to travel within a second actuation section travel slot 236 during a reloading of the firearm 100. As shown, the second actuation section 232 of the hand-held actuation arrangement 211 may be disposed on a side of the barrel 130 approximately 90 degrees (within plus (+) or minus (–) 10 degrees) from the first actuation section 212.

More particularly, the pump-action reload mechanism 200 may further comprise a second actuation section 232 of the hand-held actuation arrangement 211 which is disposed on a left side of the barrel 130 relative to a operator of firearm 100. As shown FIGS. 2E-2F, the first actuation section 212 and the second actuation section 232 are shown to be discrete components of the hand-held actuation arrangement 211 which directly connect to the fore-end body 202, and preferably do not connect directly connect to one another.

Furthermore, the pump-action reload mechanism 200 may further comprise a third hand-grip segment 243 of a third actuation section 242 of the hand-held actuation arrangement 211 which is configured to travel within a third actuation section travel slot 246 during a reloading of the firearm 100. As shown, the third actuation section 242 of the hand-held actuation arrangement 211 may be disposed on a side of the barrel 130 approximately 180 degrees (within plus (+) or minus (–) 10 degrees) from the second actuation section 232.

More particularly, the pump-action reload mechanism 200 may further comprise a third actuation section 232 of the hand-held actuation arrangement 211 which is disposed on a right side of the barrel 130 relative to a operator of firearm 100. As shown FIGS. 2E-2F, the first actuation section 212, the second actuation section 232 and the third actuation section 242 are each discrete components of the hand-held actuation arrangement 211 which directly connect to the fore-end body 202, and preferably do not connect directly to one another.

As set forth herein, the forward end of the operation rod 204 may be coupled, directly or indirectly, to the fore-end body 202 by a variety of means depending on the configuration of the firearm 100. As best shown by FIGS. 2A-2D, the operation rod 204 is shown to extend within a passage 250 within the fore-end body 202, with the passage 250 extending parallel with passage 203 of the fore-end body 202.

As best shown by FIG. 2B, a flat-spotted (planar) distal portion 252 of the operation rod 204 is keyed to fit within a planar distal portion 254 of the passage 250 to inhibit the operation rod 204 from rotating relative to the fore-end body 202. In addition, the operation rod 204 includes a recess 256 which is occupied to a retaining member/locking ring 258 which mechanically interlocks the operation rod 204 within passage 250.

Figure 3A:
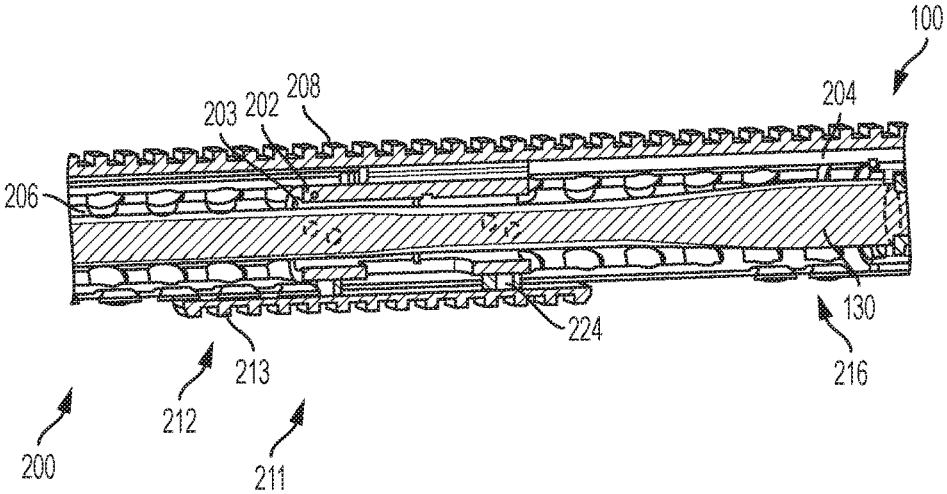
FIG. 3A is a cross-sectional perspective view of a fore-end portion of the pump-action reload mechanism of the firearm of FIG. 1 according to a second embodiment of the present disclosure.
Figure 3B:
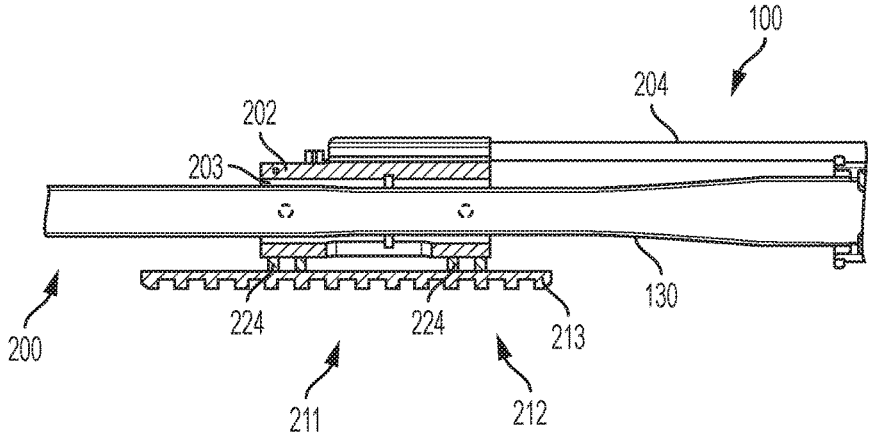
FIG. 3B is a cross-sectional side view of the fore-end portion of the pump-action reload mechanism of the second embodiment, with the handguard removed.
Figure 3C:
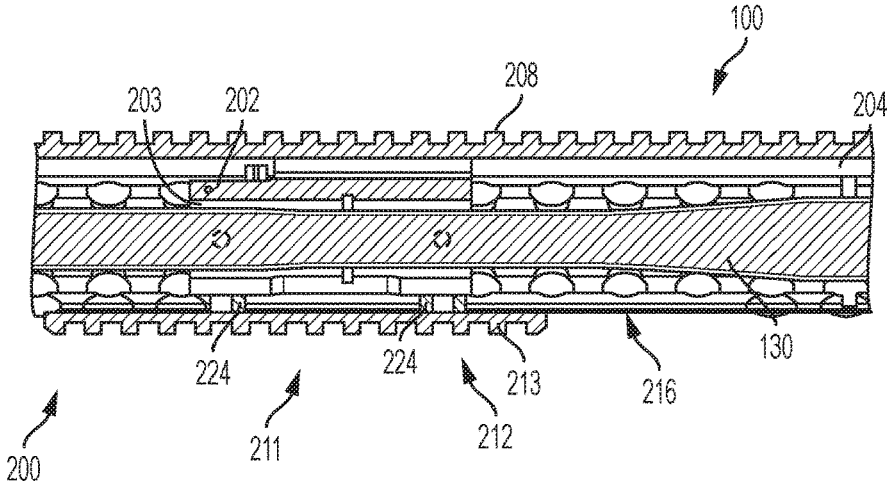
FIG. 3C is a cross-sectional side view of the fore-end portion of the pump-action reload mechanism of the second embodiment, with the handguard present.

A second embodiment of a manually operated pump-action reload mechanism 200 of a firearm 100 according to the present disclosure is illustrated in FIGS. 3A-3C. In contrast to the embodiment of FIGS. 2A-2F, with the embodiment of FIGS. 3A-3C, the operation rod 204 may be connected to the fore-end body 202 by being welded or threaded thereto, thus simplifying the attachment of the operation rod 204 to the fore-end body 202. Also in contrast to the prior embodiment, the pump-action reload mechanism 200 may only comprise a first actuation section 212 to operate the pump-action reload mechanism 200.

Turning now to FIGS. 4A-4E, there is shown a first embodiment of a bolt carrier locking mechanism 400 useful in connection with the pump-action firearm 100 as shown in FIG. 1. The function of the bold carrier locking mechanism 400 is to inhibit operation of the pump-action reload mechanism 200 when an unfired cartridge is in the chamber of barrel 130. More particularly, the bold carrier locking mechanism 400 inhibits the chamber from being partially opened, by pulling of the hand-held actuation arrangement 211 rearward when firing the firearm 100, by mechanically interlocking with the bolt carrier 120.

As shown, the bolt carrier locking mechanism 400 comprises a mechanical bolt carrier locking member 402 which inhibits (stops) rearward actuation of the pump-action reload mechanism 200 when an unfired cartridge is in the chamber of barrel 130. The bolt carrier locking member 402 may be positioned in the receiver 110 in relationship to a known configuration (e.g. the AR-15/M16 configuration) of a hammer, trigger and bolt carrier/bolt, etc. When the firearm 100 is fired during normal operation, as the hammer 412 swings forward and begins to contact the bolt carrier locking member 402, two wedge incline surfaces 414, 416 of the front face of the hammer 412 impact and interact in sequence with two corresponding wedge incline surfaces 404, 406 of the rear face of the bolt carrier locking member 402, causing the bolt carrier locking member 402 to slide laterally (transverse to a longitudinal axis of the bolt carrier 120 and the barrel 130) and retract along pin 408 (to the left as looking down the barrel of the firearm 100) out of the path of the hammer 412.

Figure 4A:
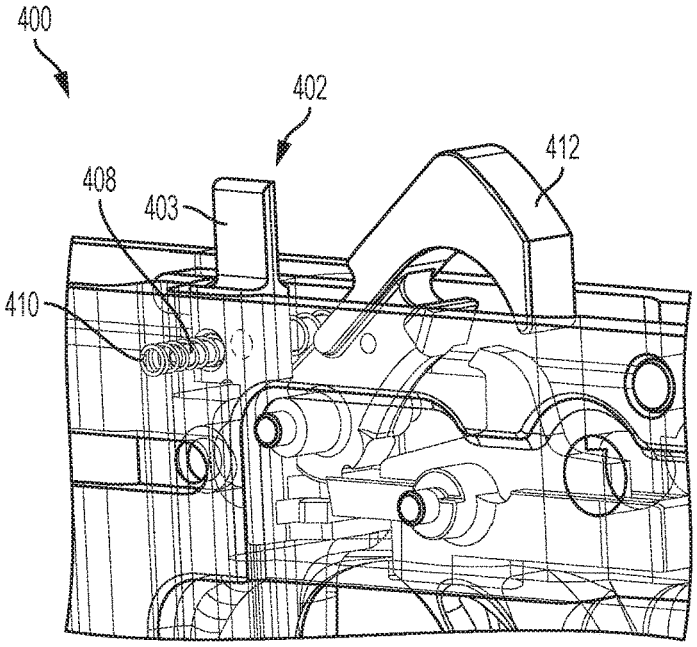
FIG. 4A is a side perspective view of a bolt carrier locking mechanism according to a first embodiment of the present disclosure.
Figure 4B:
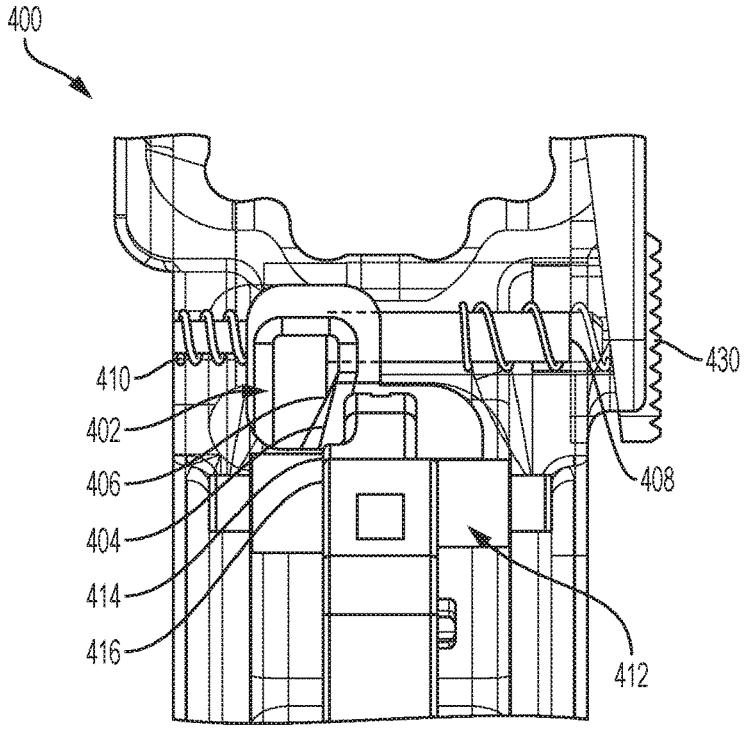
FIG. 4B is a top view of a bolt carrier locking mechanism of the first embodiment.
Figure 4C:
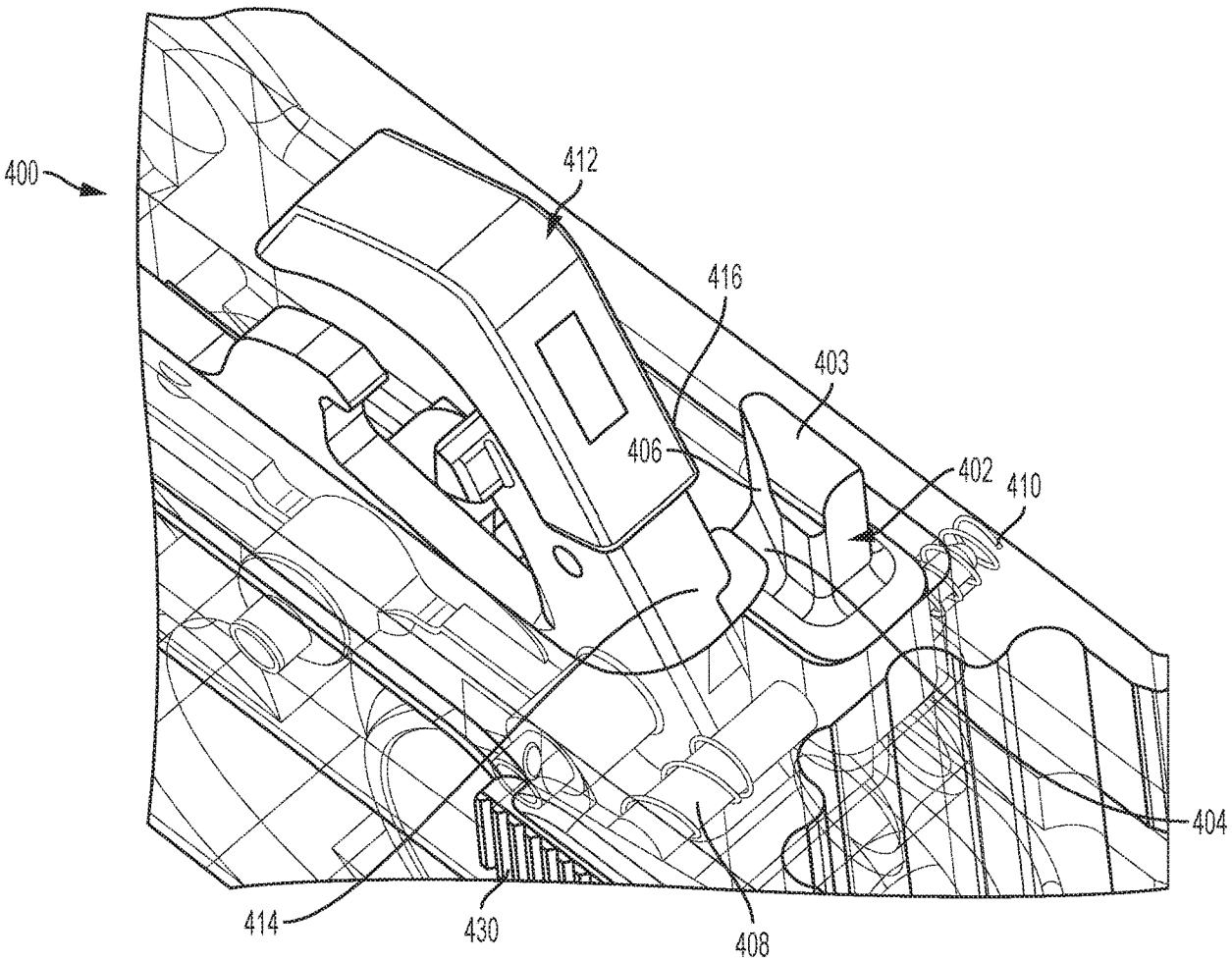
FIG. 4C is a top perspective view of a bolt carrier locking mechanism of the first embodiment.
Figure 4D:
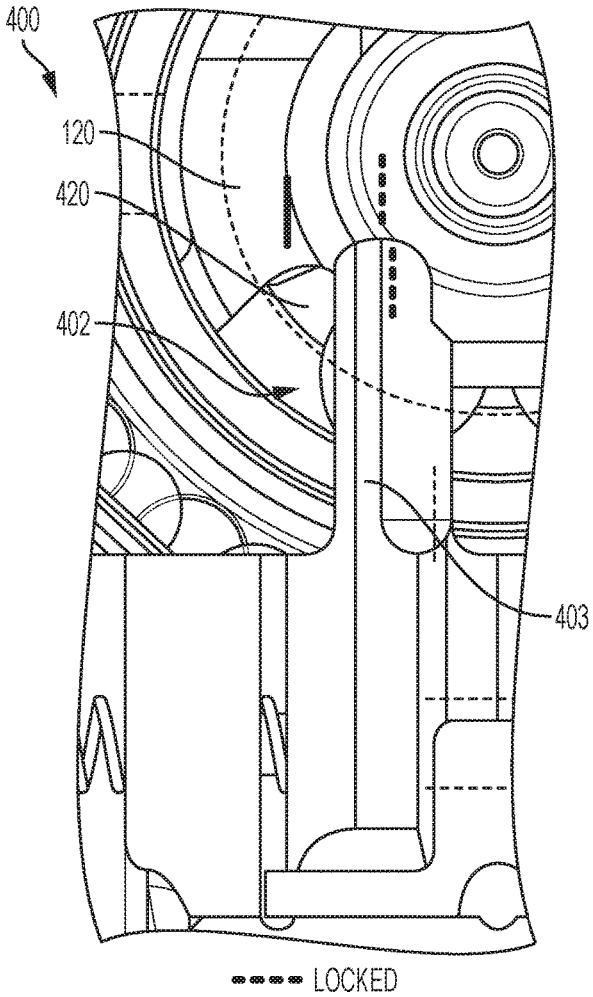
FIG. 4D is a cross-sectional view taken transverse to the longitudinal axis of the bolt carrier showing the bolt carrier locking mechanism of the first embodiment in a locked position.
Figure 4E:
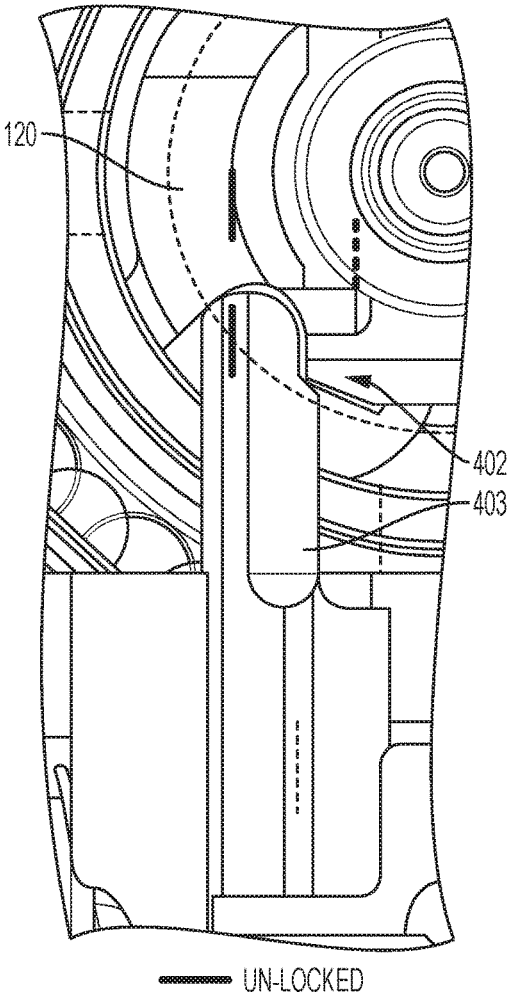
FIG. 4E is a cross-sectional view taken transverse to the longitudinal axis of the bolt carrier showing the bolt carrier locking mechanism of the first embodiment in an unlocked locked position.
Figure 5A:
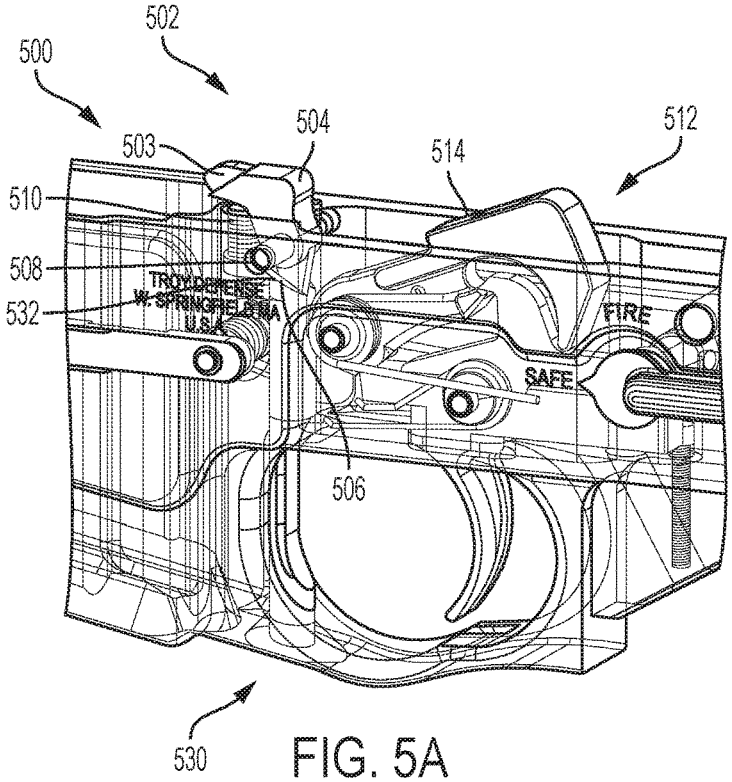
FIG. 5A a side perspective view of a bolt carrier locking mechanism according to a second embodiment of the present disclosure.
Figure 5B:
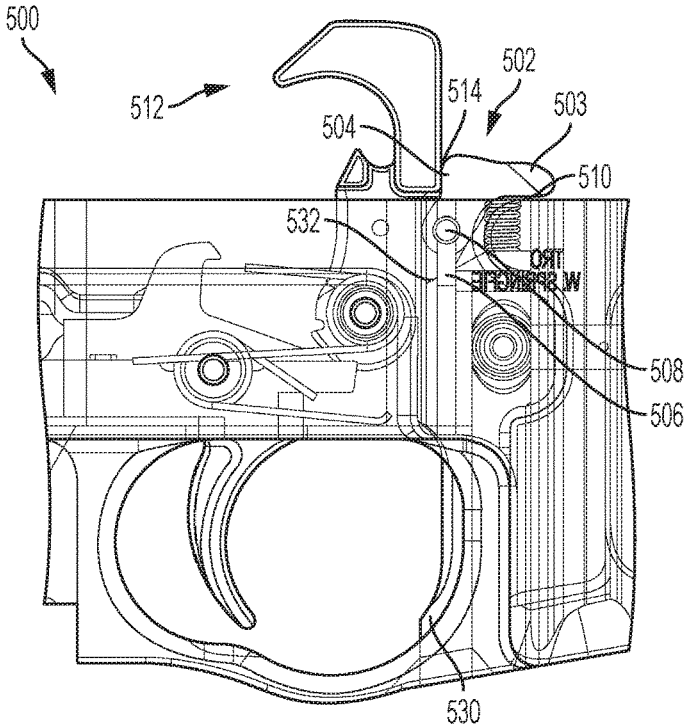
FIG. 5B is a side view of a bolt carrier locking mechanism of the second embodiment.
Figure 5C:
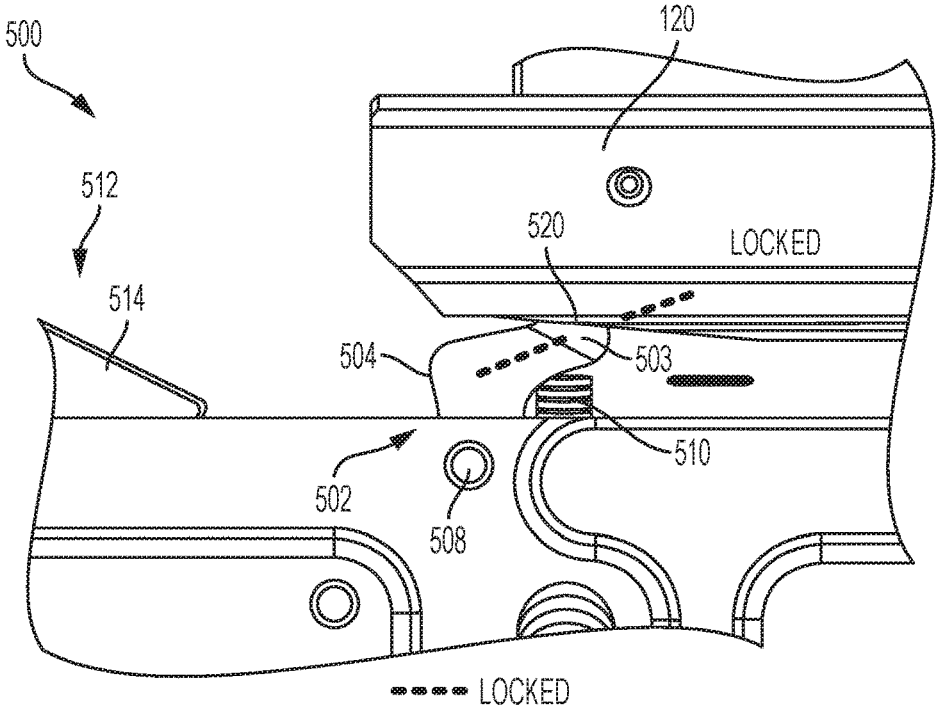
FIG. 5C is a side view of a bolt carrier locking mechanism of the second embodiment showing the bolt carrier locking mechanism in a locked position.
Figure 5D:
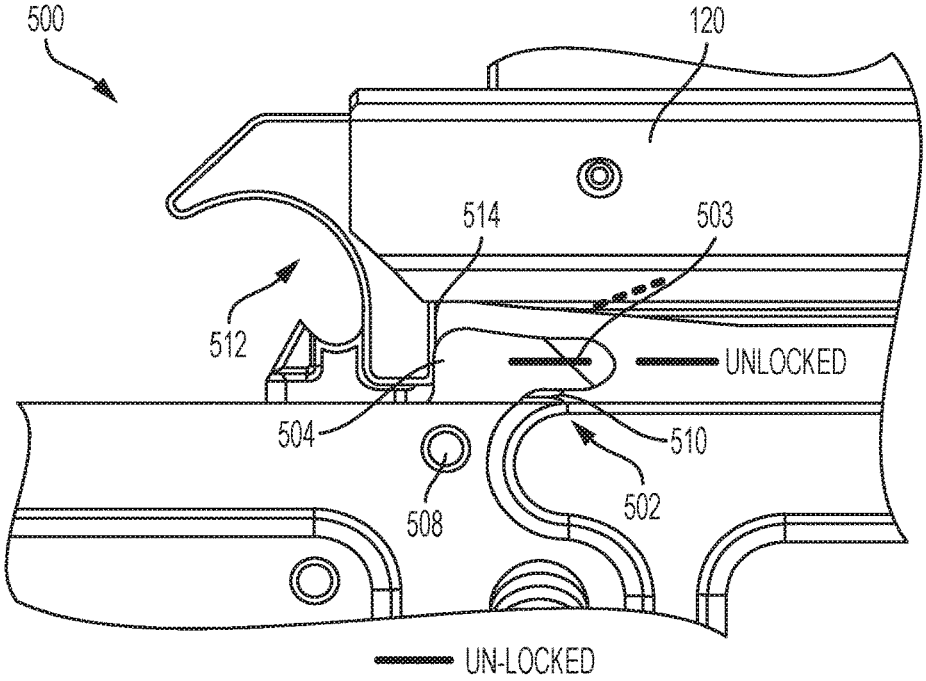
FIG. 5D is a side view of a bolt carrier locking mechanism of the second embodiment showing the bolt carrier locking mechanism in an unlocked position.

After the hammer 412 is cocked during reloading and an unfired cartridge has been fully chambered, a spring 410 overlying pin 408, which biases the lateral movement and retraction of the bolt carrier locking member 402, positions the top portion 403 of bolt carrier locking member 402 relative to the bolt carrier 120 such that the bolt carrier 120 is prevented (mechanically blocked) from moving rearward upon an attempted rearward actuation of the pump-action reload mechanism 200 (see FIG. 4D as looking down the barrel of firearm 100). Conversely, the top portion 403 of the bolt carrier locking member 402, when unlocked, occupies a recess 420 formed in the side of the bolt carrier 120 (see FIG. 4E as looking down the barrel of firearm 100).

In the event the chamber needs to be opened with the chamber containing an unfired cartridge, the operator of the firearm 100 may push the manual release button 430 located on the side of the firearm 100 to manually move the bolt carrier locking member 402 laterally relative to the bolt carrier 120 and thereafter pull the hand-held actuation arrangement 211 rearward.

Turning now to FIGS. 5A-5D, there is shown a second embodiment of a bolt carrier locking mechanism 500 useful in connection with the pump-action firearm 100 as shown in FIG. 1. Similar to the prior embodiment, the function of the bold carrier locking mechanism 500 is to inhibit operation of the pump-action reload mechanism 200 when an unfired cartridge is in the chamber of barrel 130 and more particularly, the bold carrier locking mechanism 500 inhibits the chamber from being partially opened in response to pulling of the hand-held actuation arrangement 211 rearward when firing the firearm 100 by mechanically interlocking with the bolt carrier 120.

As shown, the bolt carrier locking mechanism 500 comprises a mechanical bolt carrier locking member 502 which inhibits (stops) rearward actuation of the pump-action reload mechanism 200 when an unfired cartridge is in the chamber of barrel 130. The bolt carrier locking member 502 may be positioned in the receiver in relationship to a known configuration (e.g. the AR-15 configuration) of a hammer, trigger and bolt, etc. When the firearm 100 is fired during normal operation, as the hammer 512 swings forward, the surface 514 of the front face of the hammer 512 impacts surface 504 of the rear face of the bolt carrier locking member 502, causing the bolt carrier locking member 502 to rotate clock-wise about pivot pin 508 (when viewed from the right (ejection) side of the firearm 100) and the locking tab 503 of the bolt carrier locking member 502 to retract downward and disengage from a slotted recess 520 in the bottom of the bolt carrier 120.

After the hammer 512 is cocked during reloading and a cartridge has been fully chambered, a spring 510 in front of pivot pin 508 biases the retraction and disengagement of the bolt carrier locking member 502 and forces the locking tab 503 of the bolt carrier locking member 502 to enter the slotted recess 520 in the bottom of the bolt carrier 120. In the event the chamber needs to be opened with the chamber containing an unfired cartridge, the operator of the firearm 100 may push the manual release button 530 located on the bottom of the firearm 100 as part of the trigger guard.

As shown, the manual release button 530 comprises an elongated rod with an angled distal end surface 532 which opposing angled distal end surface 506 of bolt carrier locking member 502. As such, when the manual release button 530 is pushed, the angled distal end surface 532 of the manual release button 530 acts on the angled distal end surface 506 of bolt carrier locking member 502, causing the bolt carrier locking member 502 to rotate clockwise about pivot pin 508 and the locking tab 503 of the bolt carrier locking member 502 to retract downward and disengage from a slotted recess 520 in the bottom of the bolt carrier 120.

Figure 6A:
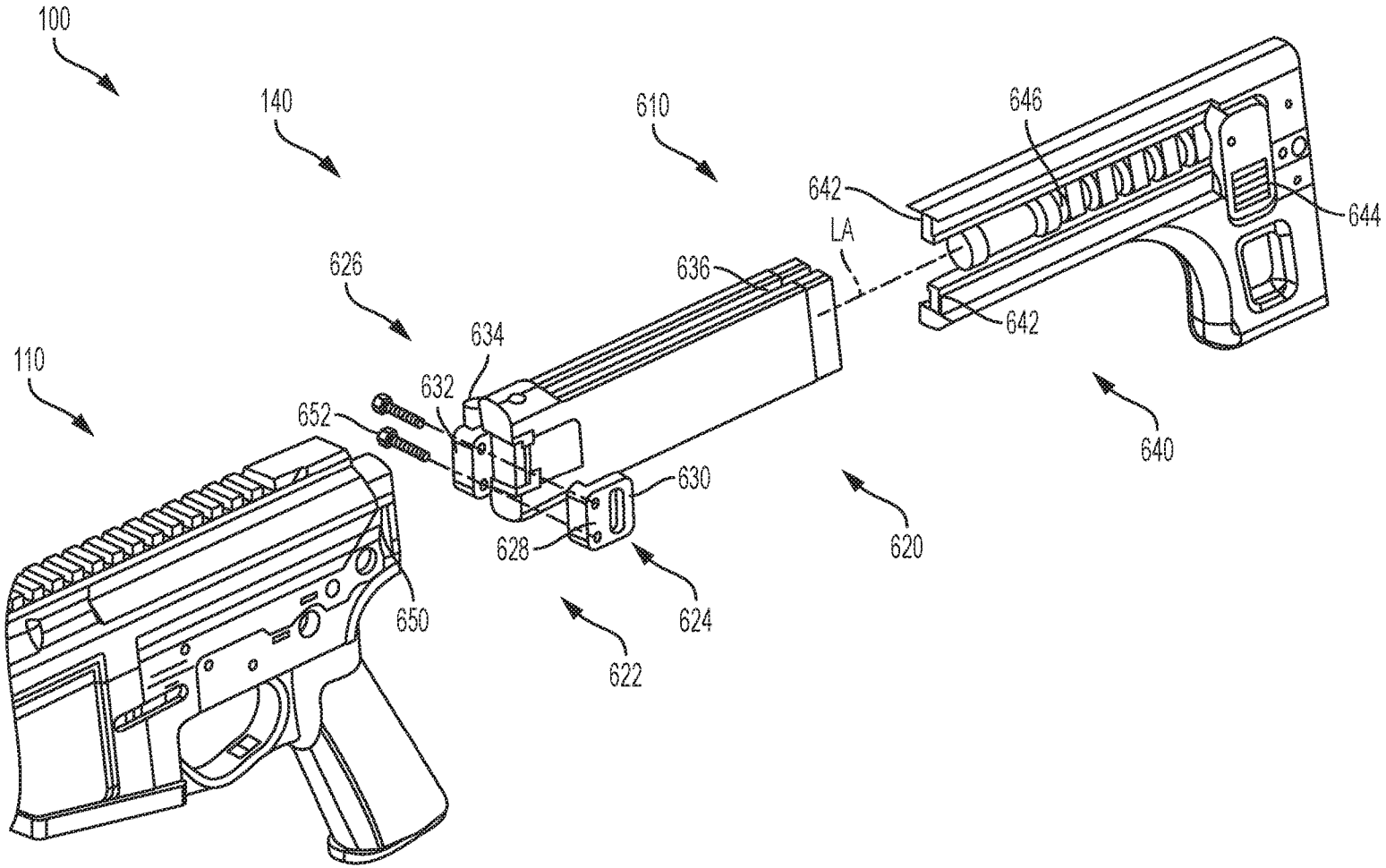
FIG. 6A is an exploded perspective view of a butt stock according to the present disclosure.
Figure 6B:
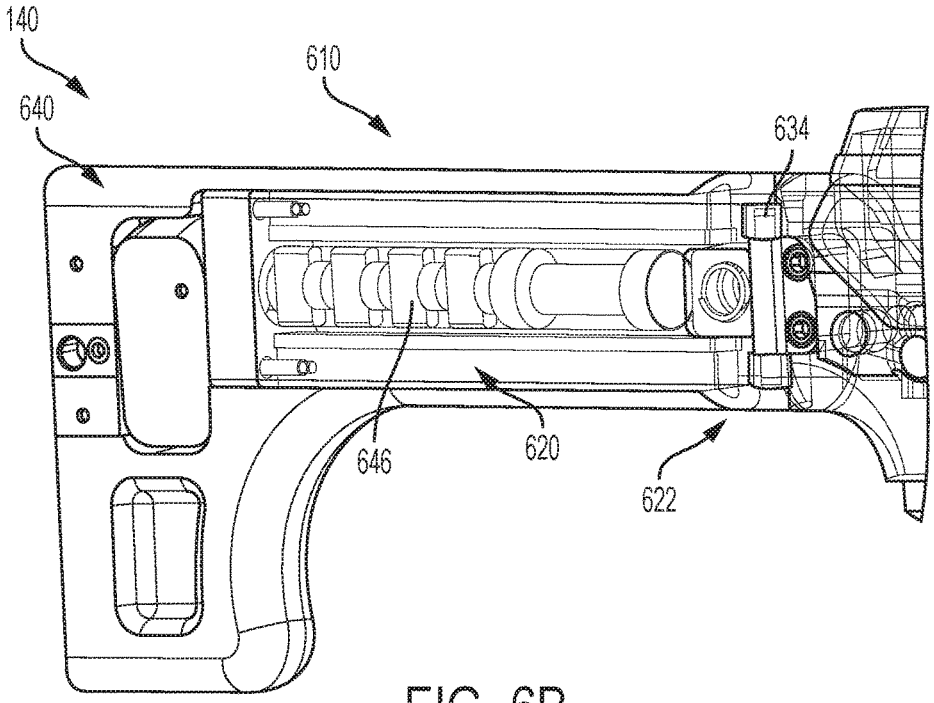
FIG. 6B is a right side assembled perspective view of the butt stock of FIG. 6A.
Figure 6C:
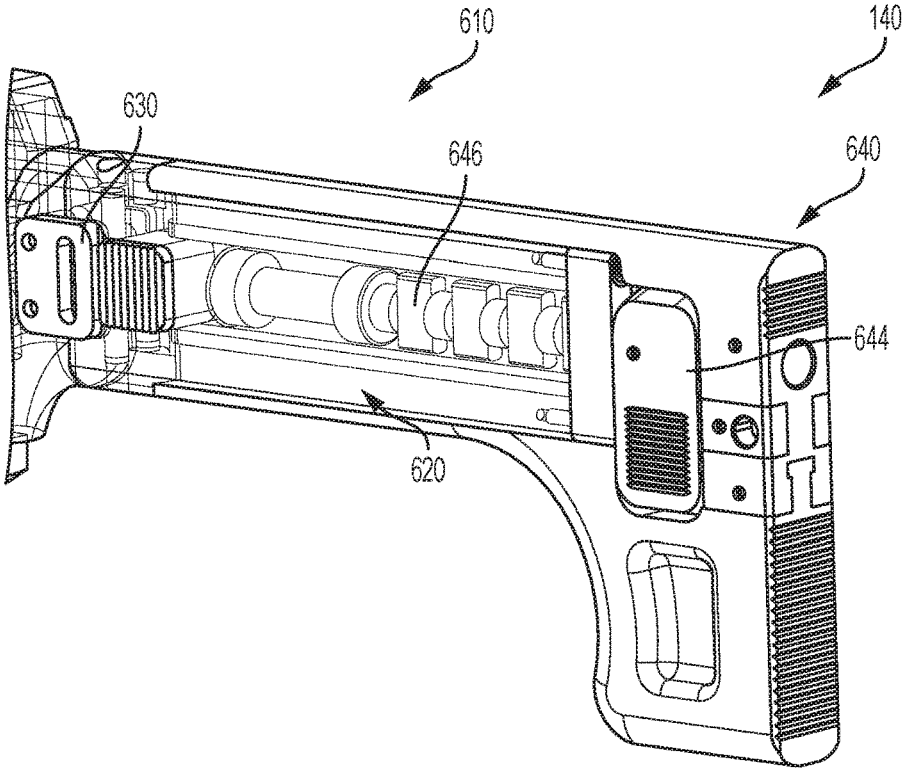
FIG. 6C is a left side assembled perspective view of the butt stock of FIG. 6A.

Turning now to FIGS. 6A-6C, there is shown an embodiment of a butt stock 140 useful in connection with a pump-action firearm 100 as shown in FIG. 1. Butt stock 140 according to the present disclosure may be used in with a wide variety of firearm configurations. This may include certain firearms in the AR-15 family of rifles, provided the return (buffer) spring is located somewhere other than the butt stock. Butt stock 140 comprises an elongated body 610 comprising a first elongated body member 620 and a second elongated body member 640. As shown, the first elongated body member 620 and the second elongated body member 640 cooperate, and more particularly slide relative to one another, to provide an extendable (telescopic) elongated body 610.

Butt stock 140 is fastened to the receiver of firearm 100 by a U-shaped mounting bracket assembly 622 which includes a first L-shaped bracket member 624 and a second L-shaped bracket member 626 which attach to opposing sides of the first elongated body 620. First L-shaped bracket member 624 comprises a mounting portion 628 and a latching portion 630, while second L-shaped bracket member 626 comprises a mounting portion 632 and a hinge portion 634.

Butt stock 140 is configured to fold approximately 180 degrees to either side of the receiver 110. In the illustrated exemplary embodiment, there are two opposing slots 650 machined in the receiver 110 to allow the hinge 634 and latch 630 to mount in and be secured with two screws 652 to opposite sides of the receiver 110. The first elongated body 620 of the butt stock 140 is vertically symmetric.

Therefore, when the screws 652 are removed, the relative sides of the latch 630 and hinge 634 may be interchangeably replaced with one another by disassembling the first elongated body 620 from the second elongated body 640, rotating the first elongated body 620 approximately 180 degrees around the longitudinal axis LA of the butt stock 140 and then reassembling the first elongated body 620 to the second elongated body 640. As shown by FIG. 6A, the second elongated body 640 comprises opposing T-shaped tongue members 642 which are designed to fit with sliding engagement in opposing T-shaped groove members 636 formed in the first elongated body 620 to provide a tongue and groove sliding track.

As such, the latch 630 and hinge 634 can effectively change places by the butt stock 140 being disassembled and the first elongated body 620 flipped 180 degrees to alter the direction of the fold of the butt stock 140. The butt stock 140 is also adjustable for length by rotating the release lever 644 which is attached to locking rod 646, which will then rotate the locking rod 646 from an locked orientation to a unlocked orientation, at which time the second elongated body 640 may be slide rearward relative to the first elongated body 620 to lengthen the butt stock 140 or slide forward relative to the first elongated body 620 to shorten the butt stock.

Thus, the butt stock 140 is arrangeable in a first configuration to fold toward a first side of a receiver 110 of the firearm 100 into a first folded position along the first side of the receiver 110, and unfoldable away from the first side of the receiver 110 of the firearm 100 into an unfolded position rearward of the receiver 110, as well as arrangeable in a second configuration to fold toward a second side of the receiver 110 of the firearm 100 into a second folded position along the second side of the receiver 110, and unfoldable away from the second side of the receiver 110 of the firearm 100 into the unfolded position rearward of the receiver 110.

While embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A butt stock for a firearm comprising:

the butt stock arrangeable in a first configuration and a second configuration;

in the first configuration, the butt stock is configured to fold toward a first side of a receiver of the firearm into a first folded position along the first side of the receiver, and unfold away from the first side of the receiver of the firearm into an unfolded position rearward of the receiver; and in the second configuration, the butt stock is configured to fold toward a second side of the receiver of the firearm into a second folded position along the second side of the receiver, and unfold away from the second side of the receiver of the firearm into the unfolded position rearward of the receiver.

2. The butt stock of claim 1 further comprising:
a hinge; and
wherein, in the first configuration of the butt stock, the hinge is disposed to the first side of the receiver; and
wherein, in the second configuration of the butt stock, the hinge is disposed to the second side of the receiver.
3. The butt stock of claim 2 wherein:
the butt stock is connectable to the receiver by a mounting bracket member which includes the hinge.
4. The butt stock of claim 2 further comprising:
a latch; and
wherein, in the first configuration of the butt stock, the latch is disposed to the second side of the receiver; and
wherein, in the second configuration of the butt stock, the latch is disposed to the first side of the receiver.
5. The butt stock of claim 4 wherein:
the butt stock is connectable to the receiver by a mounting bracket member which includes the latch.
6. The butt stock of claim 2 further comprising:
an extendable elongated body comprising a first elongated body member and a second elongated body member;
wherein the butt stock has a longitudinal axis; and
wherein the first elongated body member includes a first side extending along the longitudinal axis, and a second side extending along the longitudinal axis opposite the first side;
wherein the first side of the first elongated body member and the second side of the first elongated body member are transposed in the first configuration and the second configuration, respectively.
7. The butt stock of claim 6 wherein:
the second body member slides relative to the first body member to adjust a length of the butt stock.
8. The butt stock of claim 7 wherein:
the length of the butt stock is lockable by a locking mechanism.
9. A firearm, comprising:
a receiver;
a barrel located at a forward end of the receiver;
a butt stock located at a rearward end of the receiver;
the butt stock arrangeable in a first configuration and a second configuration;
in the first configuration, the butt stock is configured to fold toward a first side of the receiver of the firearm into a first folded position along the first side of the receiver, and unfold away from the first side of the receiver of the firearm into an unfolded position rearward of the receiver; and
in the second configuration, the butt stock is configured to fold toward a second side of the receiver of the firearm into a second folded position along the second side of the receiver, and unfold away from the second side of the receiver of the firearm into the unfolded position rearward of the receiver.
10. A butt stock for a firearm comprising:
the butt stock arrangeable in a first configuration to fold toward a first side of a receiver of the firearm into a first folded position along the first side of the receiver, and unfoldable away from the first side of the receiver of the firearm into an unfolded position rearward of the receiver;
the butt stock arrangeable in a second configuration to fold toward a second side of the receiver of the firearm into a second folded position along the second side of the receiver, and unfoldable away from the second side of the receiver of the firearm into the unfolded position rearward of the receiver;
a hinge and a latch;
wherein, in the first configuration of the butt stock, the hinge is disposed to the first side of the receiver and the latch is disposed to the second side of the receiver;
wherein, in the second configuration of the butt stock, the hinge is disposed to the second side of the receiver and the latch is disposed to the first side of the receiver;
an extendable elongated body comprising a first elongated body member and a second elongated body member;
wherein the second body member slides relative to the first body member to adjust a length of the butt stock; and
the length of the butt stock is lockable by a locking mechanism.
11. The butt stock of claim 2 further comprising:
an extendable elongated body;
wherein the butt stock has a longitudinal axis; and
wherein the extendable elongated body includes a first side extending along the longitudinal axis, and a second side extending along the longitudinal axis opposite the first side; and
wherein the first side of the extendable elongated body and the second side of the extendable elongated body are transposed in the first configuration and the second configuration, respectively.
12. The butt stock of claim 11 wherein:
wherein the first side of the extendable elongated body has a first side mounting structure configured to mount a mounting portion of a hinge; and
wherein the second side of the extendable elongated body has a second side mounting structure configured to mount a mounting portion of a latch.

* * * * *